US007758835B2

(12) United States Patent
Luomaharju et al.

(10) Patent No.: US 7,758,835 B2
(45) Date of Patent: Jul. 20, 2010

(54) METHOD FOR TREATING FLY ASH IN A FLUIDIZED BED BOILER AND BOILER PLANT

(75) Inventors: Tero Luomaharju, Kämmenniemi (FI); Jani Lehto, Tampere (FI)

(73) Assignee: Metso Power Oy, Tampere (FI)

( * ) Notice: Subject to any disclaimer, the term of this patent is extended or adjusted under 35 U.S.C. 154(b) by 1176 days.

(21) Appl. No.: 11/319,574

(22) Filed: Dec. 29, 2005

(65) Prior Publication Data

US 2006/0140832 A1 Jun. 29, 2006

(30) Foreign Application Priority Data

Dec. 29, 2004 (FI) ..... 20041683

(51) Int. Cl.
*B01D 45/00* (2006.01)

(52) U.S. Cl. ..... 423/215.5; 423/212

(58) Field of Classification Search ..... 423/215.5, 423/212, 213.2, 245.1, 210
See application file for complete search history.

(56) References Cited

U.S. PATENT DOCUMENTS

| | | | |
|---|---|---|---|
| 4,664,887 | A | 5/1987 | Engström |
| 4,977,837 | A | 12/1990 | Roos et al. |
| 5,086,715 | A | 2/1992 | Bürgin et al. |

FOREIGN PATENT DOCUMENTS

| | | | |
|---|---|---|---|
| DE | 3733831 | A1 | 4/1989 |
| EP | 0659462 | A1 | 6/1995 |
| EP | 0999412 | A1 | 5/2000 |
| FI | 110025 | B | 11/2002 |

*Primary Examiner*—Edward M Johnson
(74) *Attorney, Agent, or Firm*—Venable LLP; Eric J. Franklin

(57) ABSTRACT

A method for treating fly ash of flue gas exiting a furnace of a fluidized bed boiler. A side flow conveying a first fraction of fly ash is separated from a flow conveying a second fraction of fly ash. After the separation, the side flow conveying the first fraction has a higher solids content than the flow conveying the second fraction. The first fraction of fly ash is separated from the side flow at a separation temperature of at least 400° C., whereafter the first fraction of fly ash is discharged from the process.

21 Claims, 4 Drawing Sheets

METHOD FOR TREATING FLY ASH IN A FLUIDIZED BED BOILER AND BOILER PLANT

FIELD OF THE INVENTION

The present invention relates to a method for treating fly ash in a fluidized bed boiler. The invention also relates to a boiler plant.

BACKGROUND OF THE INVENTION

As a result of combustion process, two types of ash are formed in fluidized bed boilers: bottom ash and fly ash. The bottom ash is normally removed through the grate of the furnace from below, at a temperature of 600 to 900° C. The fly ash entrained in flue gases from the furnace is collected after all the heat surfaces at a temperature of 130 to 250° C. by means of an electrostatic precipitator or bag filter. Both bottom ash and fly ash can be recycled to the furnace.

The purpose of the incineration of waste is to reduce its volume for the final disposal and to recover its energy content. It can be estimated that a saving of at least 90% in the volume can be achieved by the incineration of landfill waste, resulting in ash that is more hygienic than the landfill waste. Waste materials produced by the incineration of waste include flue gases and solid ash. As in combustion processes in general, much attention has been paid to the control and processing of flue gases, to remove impurities. Also, attempts have been made to recover the ashes as well as possible before the final disposal.

In waste incineration, the use of fluidized bed techniques is a useful solution, but its competitive strength in comparison with the grate technique is weakened because of the larger amount of fly ash. The proportion of bottom ash, which is less problematic, is of the order of 20 to 30% of the total ash flow in the fluidized bed technique, whereas in the grate technique it is about 60 to 90%. This causes significant extra costs in the operational economy of a fluidized bed boiler plant.

In particular, the use of the fluidized bed technology in waste incineration is hindered by the waste fees that have been set considerably higher for fly ash than for bottom ash. The higher waste fees are due to the toxicity of the fly ash, because it contains heavy metals and dioxins. Attempts have been made to reduce the toxicity of the fly ash by further processing, which is expensive. A common method is to treat the ash chemically or to immobilize the components contained in the ash in a form in which their leaching from the ash, for example to the soil of the disposal site, is prevented. For example, U.S. Pat. No. 4,977,837 discloses a method, in which fly ash is separated from flue gas cooled down to about 315° C. (600 F) and is mixed with glass cullet that may originate from waste glass, and the mixtured is melted in a special vitrification oven that is heated to about 650° C. to melt the glass. The result is vitrified ash that can be used as landfill, road bed foundation, or construction material.

Disadvantages of the chemical processing methods include the extra investments and chemical costs required by them, and furthermore, if they are based on the washing of ash, the treatment of the solutions resulting from them. In the immobilization, in turn, even though the leaching can be prevented, the detrimental elements still remain encapsulated in the waste, which is always a factor of insecurity in long-term final disposal. On the other hand, if, for example, dioxins in the ash are to be decomposed, high temperatures must be used in the processing of the ash, which is energy consuming.

U.S. Pat. No. 5,086,715 discloses a method for preventing the de novo synthesis of dioxins and furans in flue gases by a so-called shock cooling step, in which the flue gases are quickly cooled by water from 450° C. to 250° C. before the step of separating the solids. In other words, this requires the supply of a particular cooling agent (water) by direct injection into the flue gas flow. The energy content corresponding to this temperature reduction is not recovered because of the cooling method.

German application publication DE 3733831 presents a coal-burning boiler coupled after a waste-incinerating fluidized bed boiler. The flue gases from the fluidized bed boiler are fed into the combustion zone of the coal-burning boiler, to destroy the dioxins contained in them at a high temperature preferably in the range of 1000 to 1200° C. After this, the solids are separated from the joint flue gases of the coal boiler and the waste boiler by an electrostatic precipitator and are cooled by a heat exchanger. It is obvious that waste incineration plants do not always have two boilers available, to be arranged one after the other in relation to the flue gas flow and one of them to be used for burning a more valuable fuel with better fuel economy, such as coal.

Attempts may be made to reduce the quantity of the fly ash to be discharged by recycling the fly ash separated by the filter into the furnace. In spite of this, the proportion of flue ash with a high waste fee remains high.

Finnish patent FI 110025 presents a method in which a particle-gas suspension from a fluidized bed reactor is divided in a cyclone separator into two fractions, of which the coarser fraction is removed from the bottom of the separator and recycled to the furnace, and the finer fraction is discharged via a central tube of the cyclone separator. This finer fraction, in turn, is divided into two fractions, of which the coarser part is separated by a particular vortex extractor and is recycled to the furnace, whereas the finer part is discharged from the central tube with the flue gas flow, and it can be separated by other methods. By this solution, it is possible to raise the degree of separation by the cyclone separator and to recycle the particles that would otherwise be discharged with the flue gas flow, by a simple arrangement into the process. Consequently, also this publication presents a technical solution based on the recycling of fly ash.

SUMMARY OF THE INVENTION

It is an aim of the invention to overcome the above-mentioned draw-backs and to present a method for minimizing the quantity of fly ash subject to a high waste fee and, respectively, to increase the quantity of the ash corresponding to bottom ash in the hazard classification. To attain this purpose, the method according to the invention is primarily characterized in that a side flow conveying a first fraction of fly ash and a flow conveying a second fraction of fly ash are separated from flue gas flow such that the side flow conveying the first fraction has a higher solids content than the flow conveying the second fraction, whereafter the first fraction is separated from the side flow and discharged.

The invention is based on separating, from the flow of flue gases, a flow conveying the first fraction of fly ash and having a significantly smaller gas volume, from which flow the fly ash is in turn separated and discharged from the process. Being discharged from the process means that it is no more recycled in the material flows of the incineration process. In this so-called side flow separated from the primary flow of flue gas, the ratio of the fly ash to the flue gas volume is significantly higher than in the original flow and in the flow conveying the second fraction into the flue gas duct, i.e. the so-called main flow. Thus, the quantity of detrimental substances in the flue gases per mass unit of fly ash remains significantly lower, and even though the detrimental substances were condensed in full onto the ash, their content in the ash is correspondingly significantly smaller than normally. Advantageously, this flow conveying the first fraction of fly ash should be processed in such a way that no condensation of detrimental substances takes place, or takes place to a clearly lesser extent. If the first fraction of fly ashes is separated from the flow at a temperature as high as possible, at least 400° C., the heavy metals, dioxins and furans of the flue gas being cooled do not condense on the ash. Thus, the ash may be disharged as waste whose hazard classification and, correspondingly, the waste fee is of the order of those for bottom ash. The second fraction of fly ash is conveyed by the flue gases through the normal processing steps.

The separation of the first and second fractions of fly ash may be based on, for example, the sorting of a coarser fraction and a finer fraction from each other.

The flue gas flow containing the first fraction of fly ash contains relatively more ash; in other words, the amount of ash per volume unit is higher than in the flue gas flow exiting the separator (the ash is more "concentrated"), and thereby the quantity of flue gases, from which the fly ash of the first fraction is separated when hot, is significantly small compared to hot purification of the whole gas flow in full scale. The flue gases, from which the fly ashes have thus been separated, can be led back to the furnace, or they are advantageously led to the flue gas duct to join the main flue gas flow left after the separation of the first fraction of fly ash. In this way, also these flue gases end up in the same final processing as the main flow.

This "side flow" formed by the first fraction and the flue gases and having a clearly smaller volume may be actively cooled, for example by means of a heat exchanger, to a desired temperature of at least 400° C. before the separation of this fly ash fraction. Alternatively, it can be allowed to settle freely to the separation temperature depending on the cooling of the flue gas flow in the flow duct. The separation of fly ash from the flue gas may be effected, for example, relatively directly after the separation of the flue gas flow containing the first fly ash fraction from the main flow of flue gases by a sorting device. In this case the separation temperature may be high, even above 800° C.

The invention does not require extra chemicals or "shock cooling" of the flue gas flow. The sorting may be implemented, for example, in a separator operating by the centrifugal principle by collecting the coarser fraction separated by the centrifugal force from the finer fraction in a vortex-like flow of flue gases, before the coarser fraction is carried with the finer fraction into the flue gas duct and via secondary heat surfaces. For this, it is possible to utilize, for example, the arrangement disclosed in Finnish patent 110025, in which the coarser fraction is separated radially outermost from the vortex flow of the flue gas/solids suspension in a tube (in the central tube of the cyclone) exiting a centrifugal separator towards the flue gas duct. This fraction that is outer-most can be removed from a peripheral area. For the removal, it is possible to utilize a suction that may be implemented by a blower or, for example, an ejector.

The proportion of the finer fraction to be separated from the fly ash with respect to the total quantity of the fly ash (the quantity of the ash that, without the separation, would be carried through the flue gas duct and the secondary heat surfaces to the separation of ashes) is preferably at least 40 wt-%.

The second fraction, which is carried with the main part of the flue gases into the flue gas duct, may be processed in the normal way; in other words, after the secondary heat surfaces, it may be separated by separation methods known as such and treated as waste subject to a higher waste fee, but its quantity is still significantly smaller than before.

The plant according to the invention, in turn, comprises:

- a sorting device arranged to separate a first, more concentrated fraction from the fly ash entering the flue gas duct,
- a side duct for conveying the first fraction away from the sorting device, and
- a separator for separating the first fraction from the flue gases flowing in the side duct.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
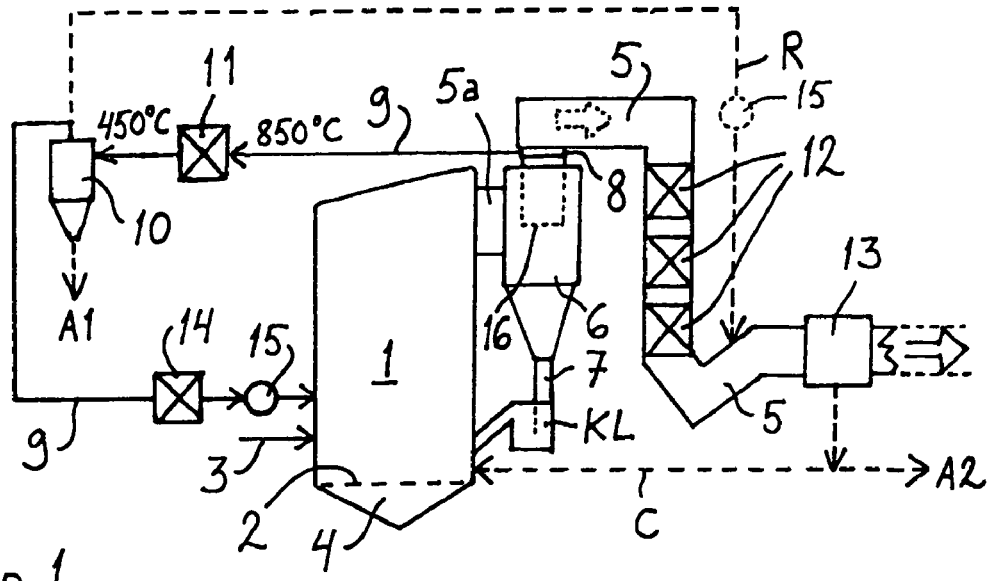
FIG. 1 is a schematic view showing the plant according to the invention.

FIG. 1 shows a plant in which the method according to the invention can be used. The plant is used for the incineration of waste, which may be, for example, municipal waste (for example solid municipal waste), industrial waste, various slurries, or special waste. For such waste, it is typical that harmful substances are produced in the incineration process, most significant of them being heavy metals, dioxins and furans which are accumulated in the fly ash carried with the flue gases.

A furnace 1 is limited from below by a grate 2 used as a structure for distributing fluidizing air and combustion air. The grate may consist of parallel hollow beams equipped with nozzles. By an upward airflow from the nozzles, bed material consisting of inert solid particles in the furnace 1 is fluidized to form a fluidized bed in which the combustion takes place. The fuel is supplied to the fluidized beds from feed inlets 3. Combustion air can be introduced into the furnace from one or more levels.

Below the grate 2, the furnace 1 comprises a unit 4 for removing bottom ashes, the operation of the unit 4 being known as such.

The walls of the furnace 1 are equipped with heat transfer tubes for transferring combustion heat into water and steam flowing in the tubes.

The furnace 1 operates by the principle of a circulating fluidized bed (CFB); in other words, the boiler is a so-called circulating fluidized bed boiler. From the furnace 1, the flue gases and the solids carried by them first pass through an outlet duct 5*a* to a cyclone separator 6, which separates the fluidized bed material from the flue gases and recycles it into the furnace 1 through a return duct 7 exiting from the bottom of the cyclone and through a loop seal structure KL known as such. The flue gases, from which the fluidized bed material has been separated, and the fly ash entrained in the flue gases, are passed through the upper part of the cyclone separator 6 into the flue gas duct 5. After the cyclone separator, the flue gas duct 5 comprises secondary heat surfaces used as heat exchangers.

When waste is incinerated, a temperature required by the waste directive (higher than 850° C.) and a long retention time are maintained in the furnace 1. According to the waste incineration directive 2000/76/EC, incineration plants shall be designed, equipped, built and operated in such a way that the gas resulting from the process is raised, after the last injection of combustion air, in a controlled and homogeneous fashion and even under the most unfavourable conditions, to a temperature of 850° C., as measured near the inner wall or at another representative point of the combustion chamber as authorized by the compentent authority, for two seconds. If hazardous wastes with a content of more than 1% of halogenated organic substances, expressed as chlorine, are incinerated, the temperature has to be raised to 1100° C. for at least two seconds.

At the outlet point of flue gases from the cyclone separator 6 of the boiler, a sorting device 8 is placed, whose structure and location will be described in more detail below. The sorting device 8 separates a part that contains the coarsest fraction of the flue ash as a side flow from the flue gas flow. The amount of flue gases, defined as a volumetric flow, is significantly smaller in this side flow than in the main flow entering the flue gas duct 5 and containing the finer fraction of fly ash. Further, it can be mentioned that at the point of cyclone outlet, the flue gases have not yet cooled to a significant extent; that is, their temperature is practically the same as the temperature used for waste incineration, for example.

A duct 9 exits from the sorting device 8 and comprises a separator 10 for separating fly ash as solid particles from the flue gas. The duct 9 and possible heat exchangers in it are provided so that the separating temperature (the gas temperature) is at least 400° C., preferably at least 450° C. When the temperature is in this range, heavy metals, dioxins and furans are not condensed and resynthesized on the surface of the fly ash particles. Alternatively, it is possible to omit the hot separation and to separate the fly ash in a form in which it contains the above-mentioned substances but in significantly smaller contents than normally, due to the small gas volume in comparison with the content of fly ash. Compared with the hot processing of the whole flue gas flow, only a volume of less than 5%, preferably less than 3% of the flue gases produced by the boiler must be processed. However, because a concentrated side flow of fly ash particles is obtained with the sorting device 8, due to the high degree of separation of fly ash (preferably at least 40 wt-% of the total fly ash), the processing is effective, particularly for the fly ash fraction. After the separator 10, the duct 9 extends via a possible second heat exchanger 14 to the furnace 1, to recycle the flue gases released from fly ash there. The fly ash collected in the separator 10 is ready for disposal in a disposal site (arrow A1). It will be obvious that after this, the fly ash has all the possible uses as before, with the difference that it corresponds to bottom ash in its hazard classification and is subject to a reduced waste fee.

FIG. 1 shows a heat exchanger 11 arranged in the duct 9 between the sorting device 8 and the separator 10. Thanks to the heat exchange medium flowing in the heat exchanger, the temperature of the side flow of the flue gases is reduced to a suitable range, for example from about 850° C. to a range from 400 to 500° C. The separator 10 may thus be a separator operating by the centrifugal principle, such as a cyclone. In principle, an electrostatic precipitator can also be used, but its use is limited by the materials required by the a high temperature, which increase the costs.

The flue gas duct 5, which conveys the main flow and the remaining fly ash fraction, passes after the cyclone separator 6 via secondary heat surfaces 12 to recover the thermal capacity of the flue gases. After this, the flue gases are in a state where they have typically cooled down to a temperature between 130 and 250° C. At this stage, they can be separated from the flue gases by a separator 13, which may be a bag filter or an electrostatic precipitator. The flue gases are passed further in the flue gas duct 5 to their further processing (possible purification steps), and they are then discharged into the atmosphere. The fly ash recovered by the separator 13 can be partly recycled to the furnace 1 (arrow C) and partly discharged as waste ash (arrow A2) with a higher hazard classification than the ash A1 discharged from the side flow.

Figure 2:
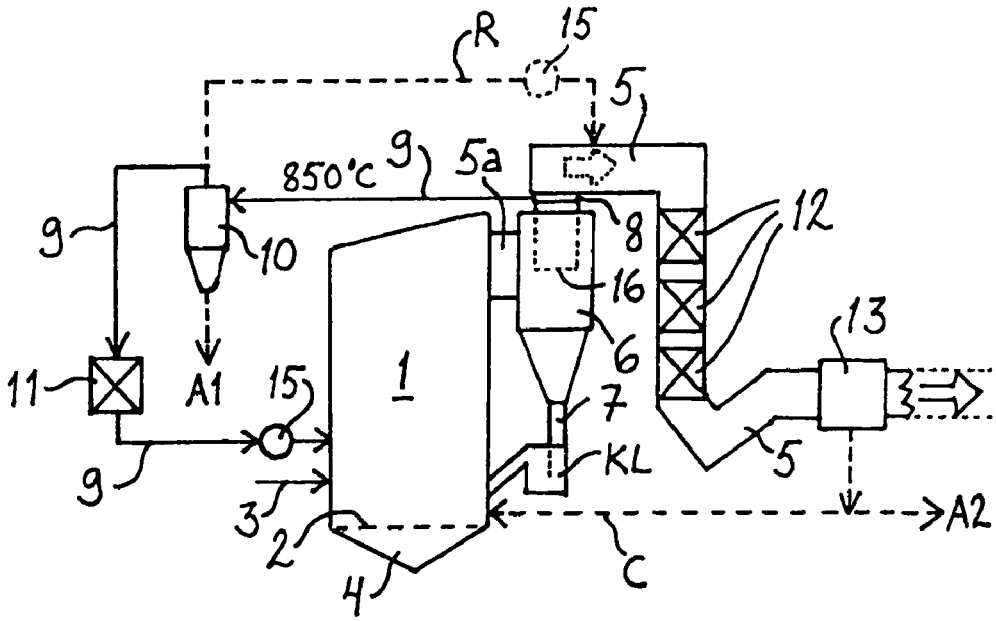
FIG. 2 shows the plant of the device according to a second embodiment.

FIG. 2 shows a plant similar to the plant of FIG. 1, the same elements being indicated with the same reference signs as above. The difference here is that the duct 9 extends directly to the separator 10 without active cooling with a heat exchanger. In this case, the separator 10 may be a cyclone, from which the duct 9 extends via the heat exchanger 11 to the furnace 1. The fly ash is separated from the flue gases in the cyclone substantially at the exit temperature of the flue gases, about 850° C., and is recovered as waste ash as above.

Figure 5:
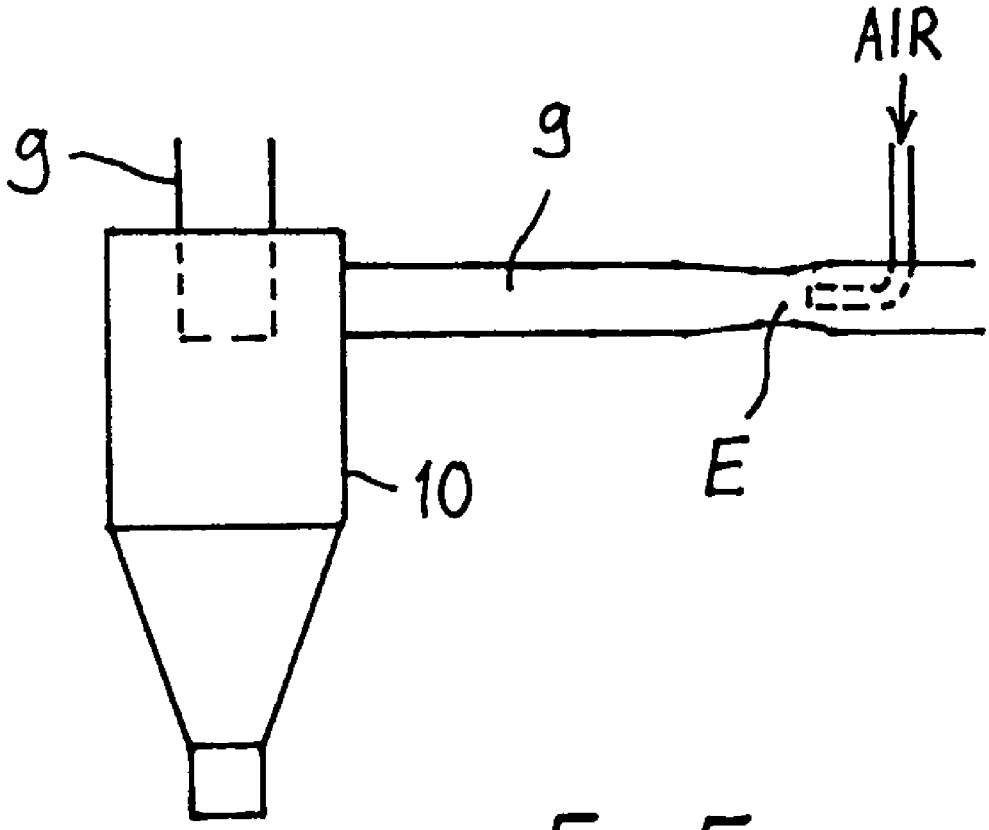
FIG. 5 shows a detail of the plant according to still one embodiment.

The suction for guiding the flue gas flow and the coarser fly ash fraction into the duct 9 is provided by a blower 15 located after the separator 10 in the embodiments of FIGS. 1 and 2. Another alternative is to use an ejector structure in the duct 9 to provide suction effective on the sorting device 8. The ejector structure can be used to replace, for example, the first heat exchanger of FIG. 1 for cooling the flue gas flow. It is thus possible to use air as the cooling medium (for example, indoor air from the plant building). The air is supplied at normal temperature by the ejector directly into the duct, and it simultaneously acts as a medium to produce the suction effect. The air is supplied in a quantity required to reduce the temperature of the flue gas flow to a suitable range, for example to a range of 400 to 500° C. This air may be simultaneously used as secondary air for the incineration process, because it flows through the duct 9 to the furnace. FIG. 5 shows a detail of the process of FIG. 1, where the heat exchanger 11 is replaced by an ejector E feeding air into the duct 9.

In a corresponding manner, the ejector and the air supplied through it can be used in place of the heat exchanger 11 of FIG. 2 to provide the suction and to supply secondary air.

Another alternative is to lead the flue gas flow, after the ash separation, to the flue gas duct 5 and to connect it in this way again to the main flow of flue gases. The combining takes place advantageously at a point in which the temperature of the main flow in the flue gas duct is approximately of the same order as the temperature of the side flow introduced there. In FIG. 1, the respective return line of the side flow of flue gases from the separator 10 into the flue gas duct 5, between the secondary heat surfaces 12 and the separator 13, is indicated with the letter R. In FIG. 2, the corresponding return line R extends from the separator 10 to the flue gas duct 5, to the section before the secondary heat surfaces 12. An advantage of the recycling of the flue gases to the main flow is that they can be subjected to further processing (including purification) together with the main flow. The blower 15, which provides the suction for the sorting device 8, may be in the return line R.

Figure 3:
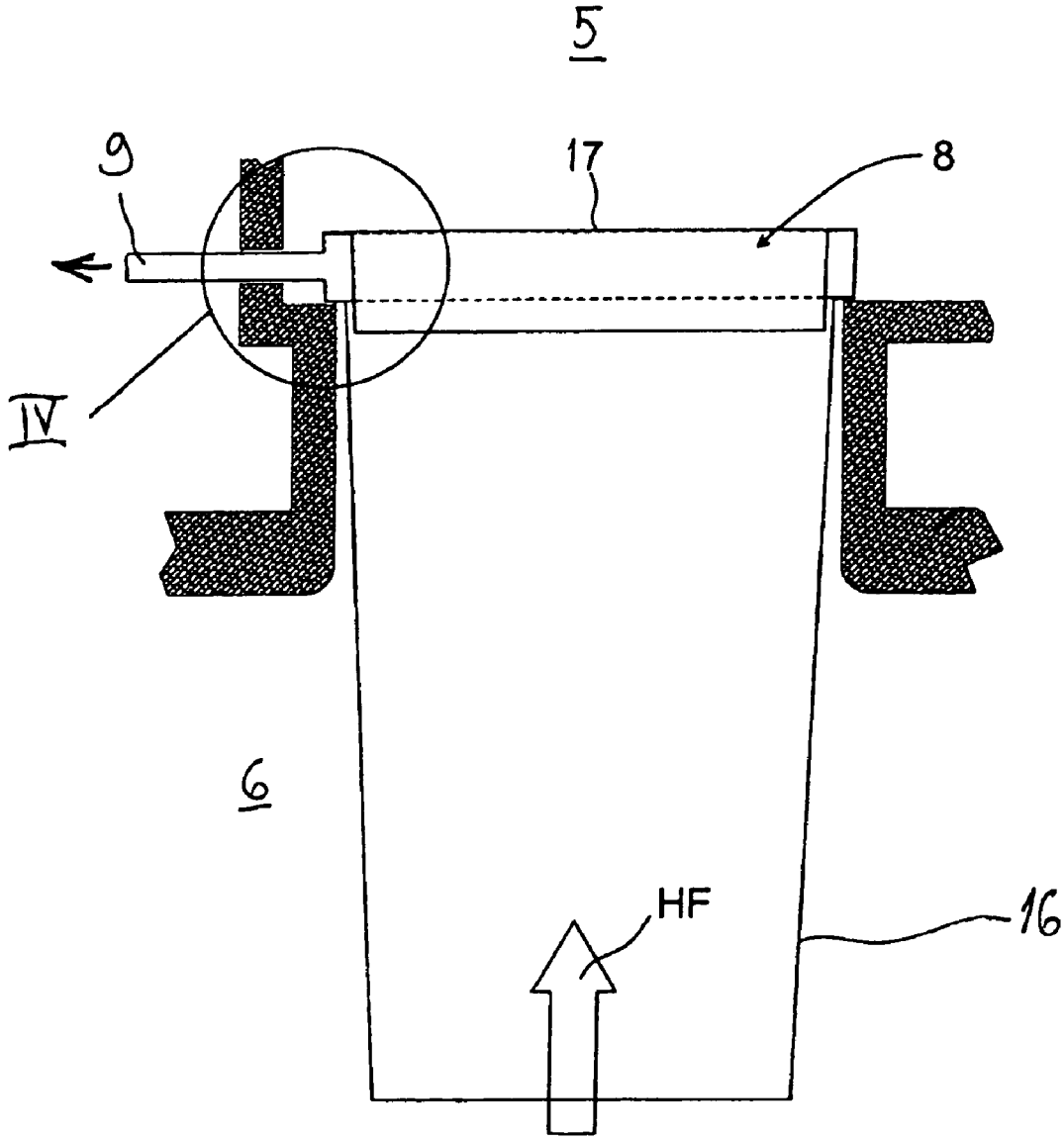
FIG. 3 shows a device for separating fly ash fractions from each other.
Figure 4:
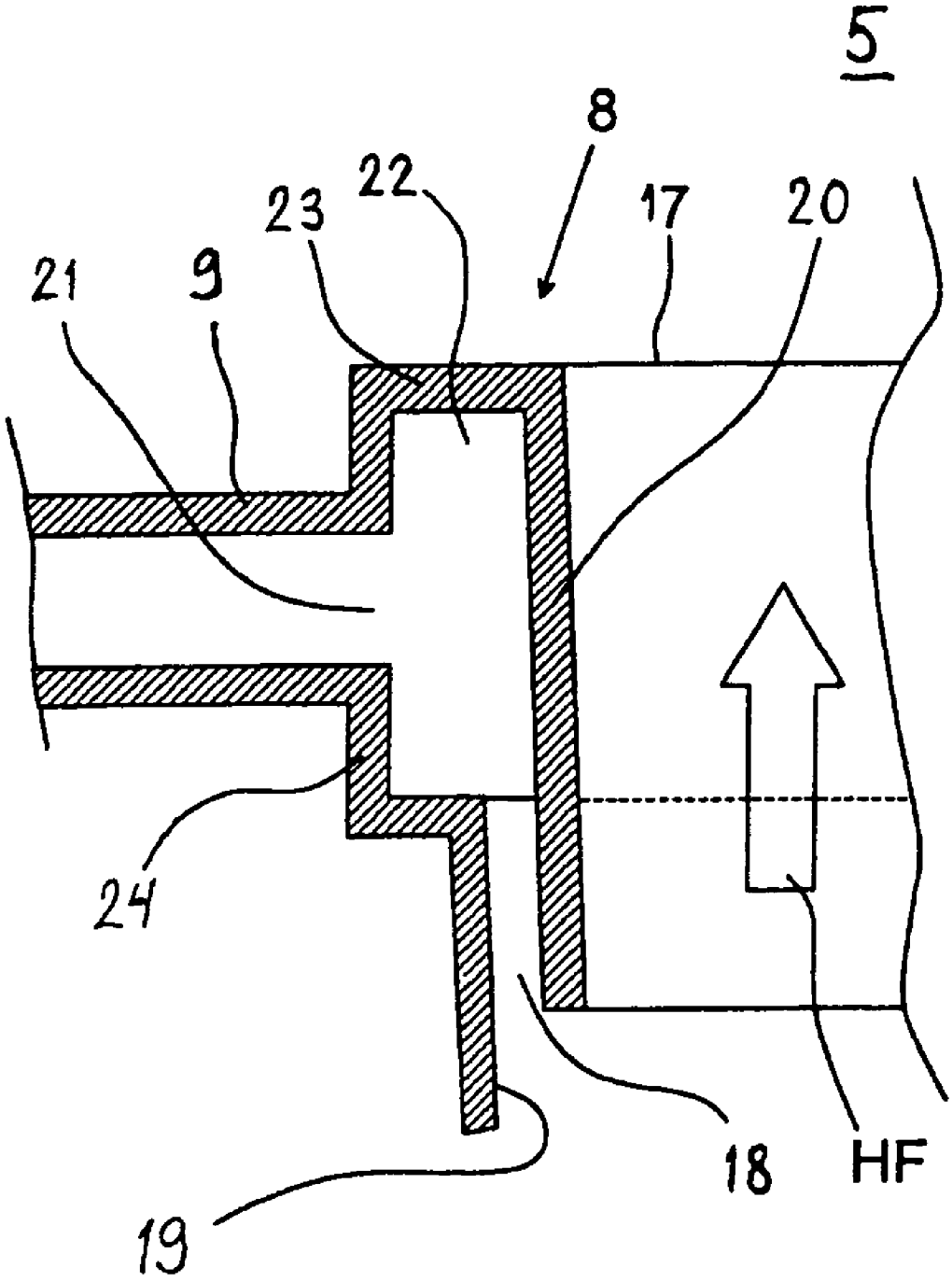
FIG. 4 shows a detail of FIG. 3.

FIGS. 3 and 4 show the structure of the sorting device 8. The sorting device is based on the observation that reseparation takes place in the finer fraction of the particle/gas suspension separated from the fluidized bed material and flowing upwards in the central tube of the cyclone used as a centrifugal separator; in other words, the finer fraction of the particle/gas suspension flowing in the central tube becomes distributed so that a higher particle density is formed closer to the inner wall of the central tube than in the center of the central tube. Consequently, the sorting is based on the utilization of the particle density gradient formed in the finer fraction of the particle/gas suspension flowing upwards in the central tube. By means of a sorting device 8 placed in the upper portion of the central tube the coarser part of this finer fraction is separated from the finer fraction to be discharged along with the main flow of flue gases from the central tube. The sorting device is provided with suction to remove this coarser part.

The sorting device is preferably an annular separator to remove said coarser part of the finer fraction from the periphery of the central tube. The annular separator is connected to the inner surface of the central tube so that it is capable of removing the coarser part of the finer fraction of the particle/gas suspension from the whole periphery of the central tube in the upper portion of the central tube. It has been found that the presence of the coarser part of the finer fraction of the particle/gas suspension is most probable on the inner surface of the wall of the central tube particularly in the upper portion of the central tube.

FIG. 4 shows a vertical central tube 16 arranged centrally in the cyclone separator 6 and receiving the finer fraction (arrow HF) of the particle/gas suspension that flows upwards in the central tube towards an outlet opening 17 in the upper portion of the central tube 16. Said sorting device 8 is arranged in the upper portion of the central tube 16 so that it is connected to the outlet opening 17 of the central tube 16. At the sorting device 8, the coarser part of the finer fraction, which has been separated close to the inner wall of the central tube 16 from the finer fraction flowing in the central tube 16, is separated from the finer fraction of the particle/gas suspension. The sorting device 8 has an annular shape, wherein the part with the finer particle size of the finer fraction is passed from the outlet opening 17 of the central tube 16, placed in the centre of the annular sorting device 8, as the above-mentioned main flow into the flue gas duct 5, from which it flows to the above-described further steps of the process, such as heat recovery from the flue gases.

FIG. 4 shows a detail of the sorting device 8 in a cross-sectional view. The sorting device 8 comprises an annular lipped slot 18 directed downwards towards the upward vortex flow (arrow HF) of the finer fraction, to form a suction nozzle. The flow rate of the finer fraction is, in normal applications, of the order of 30 to 100 m/s. The substantially vertical outer surface of the lipped slot 18 is limited by the inner surface 19 of the central tube 16. The annular and substantially vertical inner surface of the lipped slot is formed by an annular plate 20 extending in the direction of the periphery of the central tube 16, substantially vertically downwards from the edge of the outlet opening 17 of the central tube past the inlet opening 21 of the duct 9. After the lipped slot 18 the sorting device 8 comprises an annular chamber 22. The outer periphery of the chamber 22 is further out in the radial direction than the outer surface of the central tube 16. In the upper part, the annular chamber 22 is limited by a horizontal wall 23 protruding from the edge of the outlet opening 17. The portion of the initial part of the duct 9 that is connected to the sorting device may comprise one or more branches, wherein there are a corresponding number of inlet openings 21 in the vertical outer wall 24 of the chamber 22.

The transfer of the coarser part of the finer fraction to the inner wall of the wall of the central tube 16 may be facilitated by means of guide vanes which are, for example, spiral or conical. Furthermore, guide vanes may be placed in the lipped slot 18. In the presented application, the central tube 16 and the sorting device 8 are substantially cylindrical in shape, but also conical shapes are functional, either as the whole structural shape or as a part of it.

In the following, the invention will be illustrated with a non-restrictive calculatory example.

EXAMPLE

Production of Ash by Fractioning and Recycling of Fly Ash

| | |
|---|---|
| ash production from fuel | 5 t/h |
| recycling of fly ash into the furnace | 1.7 t/h |
| cyclone separating degree | 99,88% |
| mass flow into the cyclone | 1 t/s = 3600 t/h |
| out of the cyclone | 4.32 t/h (0.0012 × 3600 t/h) |
| separation degree of the sorting device 8 | 50% |
| discharge of first ash fraction | 2.16 t/h (43.2%) |
| discharge of second ash fraction | 0.46 t/h (9.2%) |
| discharge of bottom ash | 2.38 t/h (47.6%) |

From this example, it can be observed that only 9.2% of the total ash production of the plant is discharged as the second fly ash fraction with the high waste fee from the process, whereas the content of fly ash by recycling into the furnace without preceding fractioning is estimated to be of the order of 35 to 40 wt-%.

The invention claimed is:

1. A method for treating fly ash in a fluidized bed boiler in a process where fuel is incinerated in an incineration process that produces flue gas flow containing fly ash, which exits a furnace where combustion of said fuel takes place, said method comprising:

separating a side flow conveying a first fraction of fly ash from a flow conveying a second fraction of fly ash in the flue gas flow such that the side flow conveying the first fraction has a higher solids content than the flow conveying the second fraction, separating the first fraction of fly ash from the side flow at a separation temperature, and discharging said first fraction of fly ash from the process.

2. The method according to claim 1, wherein the separation temperature of the first fraction of fly ash from the side flow is at least 400° C.

3. The method according to claim 2, wherein the separation temperature of the first fraction of fly ash from the side flow is at least 450° C.

4. The method according to claim 1, wherein flue gases of the side flow conveying said first fraction of fly ash are led into the furnace after said first fraction of fly ash has been separated from said side flow.

5. The method according to claim 2, wherein flue gases of the side flow conveying said first fraction of fly ash are led into the furnace after said first fraction of fly ash has been separated from said side flow.

6. The method according to claim 1, wherein flue gases of the side flow conveying said first fraction of fly ash, after said first fraction of fly ash has been separated from the side flow, are led to the flow conveying the second fraction of fly ash.

7. The method according to claim 2, wherein flue gases of the side flow conveying said first fraction of fly ash, after said first fraction of fly ash has been separated from the side flow, are led to the flow conveying the second fraction of fly ash.

8. The method according to claim 2, wherein the side flow conveying said first fraction of fly ash is allowed to settle freely to the separation temperature.

9. The method according to claim 2, wherein the side flow conveying said first fraction of fly ash is cooled to the separation temperature by a heat exchanger or by direct cooling.

10. The method according to claim 1, wherein said first fraction of fly ash and said second fraction of fly ash are separated on the basis of particle size.

11. The method according to claim 2, wherein said first fraction of fly ash and said second fraction of fly ash are separated on the basis of particle size.

12. The method according to claim 10, wherein said first fraction of fly ash is coarser fraction.

13. The method according to claim 1, wherein said side flow separated from the flue gas flow and conveying said first fraction of fly ash has a volume which is less than 5% of total volume of the flue gas flow.

14. The method according to claim 1, wherein suction is utilized in the separation of said side flow from the flue gas flow.

15. The method according to claim 9, wherein said side flow is cooled by supplying a medium having a lower temperature into said side flow such that simultaneously an ejection effect is produced, which causes suction effective in the separation of said side flow from the flue gas flow.

16. The method according to claim 1, wherein the fuel comprises substances that produce dioxins, furans and/or heavy metals.

17. The method according to claim 2, wherein the fuel comprises substances that produce dioxins, furans and/or heavy metals.

18. The method according to claim 16, wherein the fuel is waste.

19. The method according to claim 17, wherein the fuel is waste.

20. The method according to claim 1, wherein the fluidized bed boiler is operated by the principle of a circulating fluidized bed.

21. The method according to claim 2, wherein the fluidized bed boiler is operated by the principle of a circulating fluidized bed.

* * * * *